United States Patent [19]

Jordan

[11] 4,096,840

[45] Jun. 27, 1978

[54] PULSE IGNITION DISTRIBUTOR

[76] Inventor: Richard J. Jordan, 15821 Chestnut, Roseville, Mich. 48066

[21] Appl. No.: 752,463

[22] Filed: Dec. 20, 1976

Related U.S. Application Data

[63] Continuation of Ser. No. 654,376, Feb. 2, 1976, abandoned, which is a continuation of Ser. No. 481,196, Jun. 20, 1974, abandoned.

[51] Int. Cl.[2] ..... F02P 5/00

[52] U.S. Cl. ..... 123/146.5 A; 200/19 R

[58] Field of Search ..... 123/146.5 A, 148 E, 123/117 R, 117 A; 200/19 R, 24, 28

[56] References Cited

U.S. PATENT DOCUMENTS

| | | | |
|---|---|---|---|
| 1,172,173 | 2/1916 | Shryock | 200/24 |
| 2,997,552 | 8/1961 | Silverschotz | 200/24 |
| 3,206,565 | 9/1965 | Lingenfelter | 200/28 |
| 3,504,141 | 3/1970 | Webster | 123/146.5 A |
| 3,575,150 | 4/1971 | Habert | 123/117 R |
| 3,751,610 | 8/1973 | Bednarz | 123/146.5 A |
| 3,789,168 | 1/1974 | Meyer, Jr. et al. | 123/148 E |
| 3,799,135 | 3/1974 | House | 123/146.5 A |
| 3,822,686 | 7/1974 | Gallo | 123/146.5 A |
| 3,886,916 | 6/1975 | Henderson | 123/117 R |

*Primary Examiner*—Charles J. Myhre
*Assistant Examiner*—Andrew M. Dolinar
*Attorney, Agent, or Firm*—Hauke & Patalidis

[57] ABSTRACT

An ignition distributor, for an internal combustion engine, comprising a conventional distributor body housing and a cap having a centrally disposed input terminal and peripherally disposed output terminals connected to the engine spark plugs. A rotor is mounted on the end of the distributor shaft, and a dielectric timing ring is concentrically disposed in the housing between the rotor and the cap peripheral terminals. The timing ring has a conductive segment for each terminal, and the angular positioning of the timing ring segments relative to their corresponding spark plug terminals determine the timing of the beginning of the sparking across the gap between the rotor end contact and the spark plug terminal, and consequently across the corresponding spark plug electrodes. The timing ring is supported by a plate which is angularly orientable by way of a conventional vacuum spark timing mechanism. The distributor input terminal is connected to a high voltage pulse generator, and the breaker points, cam, capacitor and ignition coil, generally associated with conventional ignition systems, are omitted.

4 Claims, 3 Drawing Figures

PULSE IGNITION DISTRIBUTOR

This is a continuation of application Ser. No. 654,376, filed Feb. 2, 1976, now abandoned, which was in turn a continuation of application Ser. No. 481,196 filed Jun. 20, 1974, now abandoned.

CROSS REFERENCE TO RELATED APPLICATIONS

The present application is related to copending application Ser. No. 463,001, filed Apr. 26, 1974, now U.S. Pat. No. 3,900,786, issued Aug. 19, 1975 which is a continuation of application Ser. No. 284,309, filed Aug. 20, 1972, now abandoned, for "Ignition Pulse Generating System".

BACKGROUND OF THE INVENTION

Conventional spark ignition systems for internal combustion engines generally comprise an ignition coil, or transformer, having a primary winding connected in series with a source of low voltage direct current and with ignition distributor breaker points. A capacitor is connected across the breaker points, and the breaker points are operated by a cam mounted on the distributor shaft. The distributor shaft is driven generally from the engine camshaft. The ignition coil, or transformer, has a secondary winding connected between ground and the center terminal of the distributor cap. The spark plugs are connected to the peripheral terminal on the distributor cap. A distributor rotor is fitted at the upper end of the shaft, and the rotor has a contact, such as a carbon brush, constantly in engagement with the distributor cap central terminal. The rotation of the shaft causes the cam mounted thereon to interrupt the circuit of the primary winding, thus inducing a high voltage pulse in the secondary winding, at the same time as the end contact of the rotor is proximate an appropriate output terminal. The high voltage induced in the secondary winding is thus allowed to pass through the rotor to the appropriate spark plug.

The timing of the spark is varied as a function of engine r.p.m. and of the vacuum in the inlet manifold. Centrifugal weights are mounted on the distributor shaft lower end and, by appropriate mechanical link and lever, the amount of radial displacement of the weights is converted to an angular displacement of the upper end of the shaft relative to its lower end. The negative pressure in the inlet manifold causes deflection of a diaphragm which in turn, by means of an appropriate link, causes an angular displacement of the breaker points support plate. The spark timing is thus affected by the engine r.p.m. and by the negative pressure in the inlet manifold, such that a spark occurs at the spark plug at the appropriate instant for best operation of the engine.

Conventional spark ignition systems for internal combustion engines are subject to many disadvantages and shortcomings. Decreased primary voltage causes a decreased secondary voltage such that the voltage across the spark plug electrodes may be insufficient to "fire" the spark plug. Corroded, pitted or dirty breaker points, breaker point oscillation or rebound, especially at high r.p.m., cause misfiring of firing out of timing, with resulting losses in efficiency or complete failure of engine operation. Spark plugs are subject to fouling, for example by oil or carbon deposits, or to shortcircuiting by bridging of the electrode gap by carbon or by metallic gasoline additives, and conventional ignitions systems providing a single pulse across the spark plug gap are incapable of maintaining the spark plug terminals perfectly clean for any long period of time.

It has been discovered that the many shortcomings and disadvantages of conventional spark ignition systems are eliminated when they are replaced by an ignition pulse system as disclosed in copending application Ser. No. 463,001, in combination with the distributor of the invention which does away with the cam operated ignition breaker points, the capacitor and the ignition coil of conventional systems. The distributor of the invention, when combined with an ignition pulse system, permits to maintain accurate timing throughout the life of an internal combustion engine, as compared to the slow deterioration due to the wear of breaking points and of the cam which is associated with conventional ignition systems, and which in turn affects motor vehicle economy, causes losses in performance and increases exhaust emission.

The distributor of the present invention, when incorporated in a pulse ignition system, in addition to greatly simplifying the structure of the distributor, as compared to a conventional distributor, permits to effectuate a precise timing of the start of the electrical discharge across the spark plug terminals, and a precisely determined duration of sparking, thus insuring complete firing and combustion of the charge introduced in the cylinders. Because timing is not dependent upon the action of mechanical parts which are subject to wear and is only depending upon the relative positioning of the distributor rotor, timing ring and spark plug terminals, such timing is precisely determined and remains constant throughout the life of the motor vehicle. In addition, conventional ignition distributors may be retrofitted by removing the unnecessary parts, such as the breaker points and capacitor, replacing the rotor by a shorter rotor, and mounting the timing ring on the breaker point plate, without any other modification of the distributor. The coil is replaced by a high voltage pulse generator as disclosed in the copending application.

SUMMARY OF THE INVENTION

The present invention, therefore, provides a distributor for internal combustion engine ignition pulse system which requires no cam operated breaker points, no capacitor and no coil, and which insures precise timing of the instant of occurrence of an electrical discharge across the electrodes of the spark plugs disposed in each cylinder of the engine. The present invention has many applications as original equipment in an internal combustion engine or in the form of a kit for adapting a conventional internal combustion engine ignition system to a high frequency high voltage pulse ignition system, by replacing the coil of a conventional ignition system with a high voltage pulse generator, by eliminating the breaker points and capacitor from a conventional distributor and by mounting a timing ring on the breaker point support plate of conventional distributor.

BRIEF DESCRIPTION OF THE DRAWINGS

In the drawings, wherein like reference numerals refer to like or equivalent parts.

DETAILED DESCRIPTION OF THE PREFERRED EMBODIMENT

Figure 3:
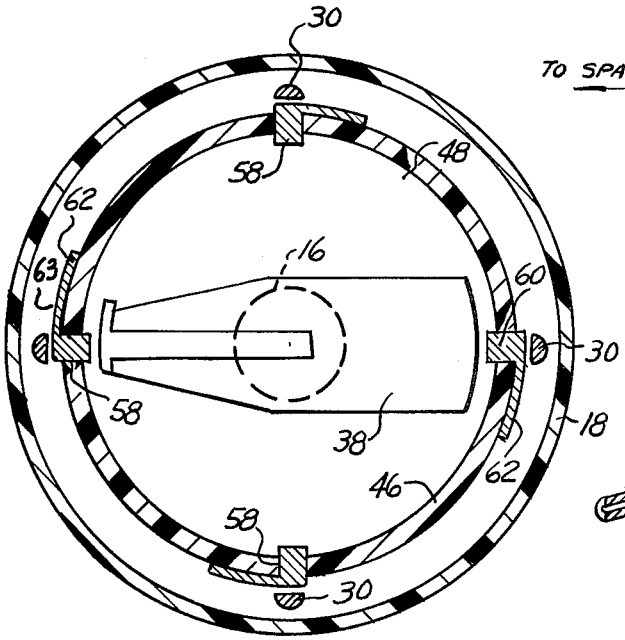
FIG. 3 is a transverse section thereof as seen from lines 3—3 of FIG. 2.

As illustrated in the drawings, the present invention takes the form of an ignition distributor which is in appearance substantially like a conventional distributor. The distributor comprises a cup-shaped housing 10 made of metal or of a dielectric material, having an end wall 12 and an open end 14. A shaft 16 projects through the center of the cup-like housing 10 through the end wall 12 thereof, and is adapted to be driven in rotation, for example, from the camshaft end of an internal combustion engine, not shown. The open end 14 of the housing 10 is closed by a removable dielectric cap 18 held in position by convenient means, such as spring clips or the like, not shown. The cap 18 is also cup-shaped and is provided with an integral end wall 20 having a centrally disposed boss 22 fitted with an inwardly projecting terminal 24 made, for example, of graphite or like material, and a plurality of peripherally disposed bosses 26, each fitted with a peripheral terminal 28 having an integral projecting portion 30. As best illustrated in a schematic manner at FIG. 1, each one of the peripheral cap terminals, or spark plug terminals, 28 is connected by means of an electrical conductor to the center electrode of a spark plug, not shown, fastened in a cylinder of an internal combustion engine, not shown. For a four cylinder engine there will be four spark plug terminals, six terminals for a six cylinder engine and eight for an eight cylinder engine. The central terminal 28 is connected to the output of a high voltage pulse generator 34, which may be as disclosed in the copending application referred to hereinbefore, that takes its energy from a battery 36, or other source of electrical energy associated with the internal combustion engine or motor vehicle.

Figure 2:
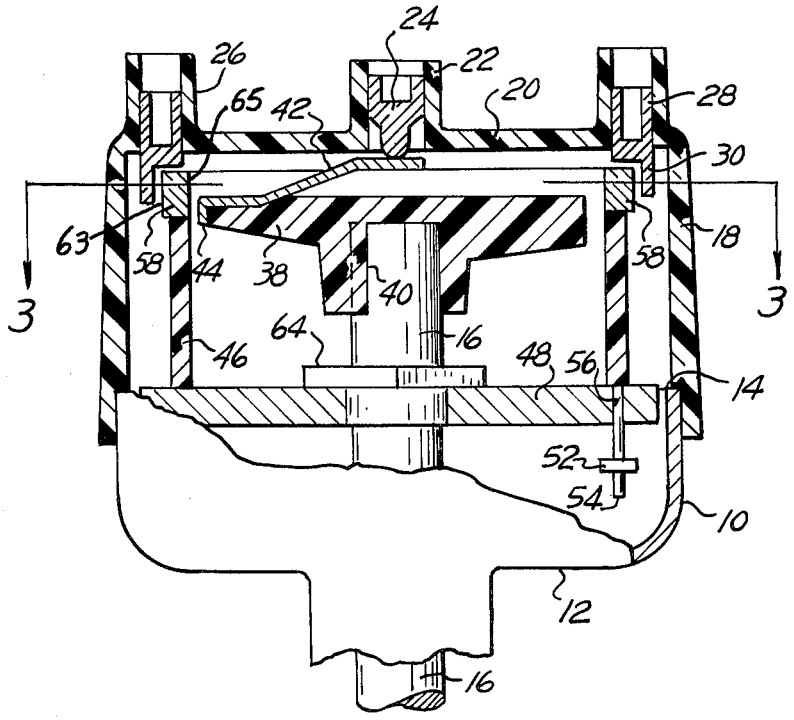
FIG. 2 is a schematic elevation view, with portions shown in section.

On the end of the shaft 16 extending within the cap 18 is mounted a rotor member 38 made of a dielectric material such as a plastic or the like, frictionally held in position and keyed in an appropriate angular position relative to the shaft, as shown at 40 in FIG. 2. A flat spring 42, appropriately shaped is supported by the rotor 38. An end of the flat spring is constantly in egagement with the projecting end of the central terminal 24, and the other end is attached to the projecting end of the rotor member 38, as shown at 44.

Figure 1:
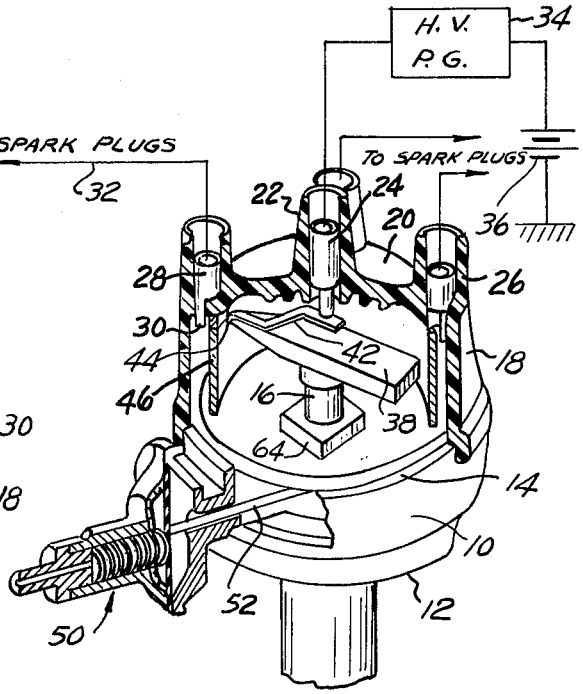
FIG. 1 is a perspective view, with portions removed to show the internal construction, of a distributor according to the present invention.

Concentrically to the shaft 16, the distributor housing 10 and the cap 18 assembly, a timing ring 46, also made of dielectric material, is mounted inside of the distributor housing 10 between the rotor member 38 and the projecting portions 30 of the spark plug terminals 28. The timing ring 46 is supported by a plate 48 through which projects the shaft 16. The plate 48 is stationary relative to the shaft 16, but is capable of angular displacement relative to the housing 10 and cap 18 of the distributor under the control of the distributor conventional advance vacuum unit 50 having a rod 52 pivotally attached to a stud 54 projecting below the plate 48 (FIGS. 1 and 2). The stud 54 may be fastened to the lower edge of the timing ring 46 and project through an appropriate aperture 56 in the plate 48. Appropriate means, not shown, such as dependent lugs projecting through appropriate apertures in the plate 48, are used for fastening the timing ring 46 to the plate 48, and in structures where a conventional distributor is modified by incorporation of the invention it is contemplated that the support plate 48 may be the original breaker point mechanism and capacitor support plate from which the breaker points and the capacitor have been removed, and through which appropriate apertures are drilled to accept the mounting lugs and connection stud 54 of the timing ring 46.

Current-conductive segments 58 are supported at the edge of the wall of the timing ring 46, each segment corresponding to each projecting portion 30 of the spark plug terminals 28. Each segment has a body portion 60 extending radially through the wall of the timing ring 46 and an arcuate integral portion 62 formed on the exterior surface of the wall of the ring. Each segment 58 acts as a bridging member disposed across the spark gap between the end contact 44 of the rotor 38 and the projecting portion 30 of the corresponding spark plug terminal 38. The end surfaces 63 of each segment 58 facing the projecting end 30 of the spark plug terminal 28 is disposed with an appropriate clearance therewith so as not to engage the surface projecting portion 30 of the terminal and define a spark gap therewith, and the inner end face 65 of the segment is similarly disposed a predetermined distance away from the end contact 44 on the rotor member 38 when aligned therewith, as shown for example at FIG. 3. There is thus formed a double spark gap between the end contact 44 of the rotor member and the appropriate spark plug terminal end portion 30 when the rotor member 38 is rotated by the shaft 16 to a position substantially aligning the spark plug terminal projecting end portion 30 and the rotor end contact 44.

In the arrangement illustrated in the drawing, a high voltage high frequency amplitude is continuously supplied to the center terminal 24 of the distributor cap 18, and distributed to the appropriate spark plug as a result of the rotation of the rotor member 38, as soon as its end contact 44 is brought sufficiently close to the inner end surface 65 of a segment 58, causing a continuous sparking through the gap therebetween and through the gap between the projecting portion 30 of an appropriate spark plug terminal 28 and the surface 63 of the arcuate portion 62 of the segment. If, for example, the rotor member 38 is caused to rotate clockwise, with reference to FIG. 3, and the illustrated relative position between the angular position of the timing ring 46 and the spark plug electrode projecting portion 30 is arbitrarily assumed to represent full retardation of the timing of the electrical discharge at the spark plugs, it can be seen that an electrical discharge will occur through the first gap between the rotor end contact 44 and the inner end face 65 of a segment 58 as soon as the gap distance is sufficiently reduced to cause ionization of the gap. Electrical discharge across that first gap and across the second gap formed between the outer end face 63 of the segment 58 and the projecting end 30 of the spark plug terminal 28 continues until the rotor member 38 has been angularly displaced sufficiently to widen the first gap to a distance too great to maintain the electrical discharge or sparking between the segment inner face 65 and the rotor end contact 44.

The timing of the beginning of the occurrence of an electrical discharge at the spark plug electrode is advanced as a result of the distributor timing mechanism angularly displacing counterclockwise the timing ring 46, such that the closure of the gap between the inner end surface 65 of the segment 58 and the rotor end contact 44 will occur at a lesser degree of rotation of the engine crankshaft. The duration of the electrical discharge is determined by the relative apparent arcuate lengths of the segment inner end face 65 and of the rotor end contact 44. In order to present opposed areas between the spark plug terminal projecting ends 30 and the segment outer surfaces 63 in the course of variation of angular position of the timing ring 46 relative to the spark plug terminals, the segments 58 may be of the form illustrated, namely with an arcuate integral projection 62, or the projecting portions 30 of the terminals may be arcuately laterally extended. In arrangements where the parts originally included in a conventional ignition distributor are adapted to the invention, the first mentioned arrangement will preferably be chosen as it requires no modification of the spark plug cap terminals. Also, in such arrangement, the original breaker point cam remains attached to the shaft 16, as shown at 64, although it accomplishes no useful function. For the purpose of providing a path to ground for the electrical discharge when the rotor member 38 rotates between consecutive segments 58, appropriate grounding terminals (not shown) may be disposed in the cap 18 or in the timing ring 46.

Having thus described the invention by way of a typical structural example thereof, modifications whereof will be apparent to those skilled in the art, what is claimed as new and sought to be protected by Letters Patent is as follows:

1. In a distributor for a spark-ignition internal combustion engine comprising a distributor body, a removable cap for said body provided with a centrally disposed input terminal and peripherally disposed output terminals each connected to a spark plug of said engine, a rotatable shaft extending through said body, a rotor mounted on the end of said shaft for placing said input terminal successively in spark gap proximity with each of said output terminals in the course of a revolution of said shaft, and timing means comprising a plate angularly positionable relative to said body about said shaft for advancing and retarding ignition as a function of engine RPM, the improvement consisting of a high voltage high frequency generator having an output constantly electrically connected to said input terminal, a dielectric timing ring disposed in said body between said rotor and said output terminals, a current conductive segment for each of said output terminals carried by said timing ring and defining a contactless bridging member disposed in said spark gap corresponding to each of said output terminals, and means for mounting said timing ring on said plate for timing the occurrence of start of sparking through said spark gap relative to degree of angular rotation of said shaft as a function of the angular position of said timing ring relative to said output terminals.

2. The improvement of claim 1 wherein the duration of sparking across said spark gap is a function of the effective arc length of said segment.

3. A breaker-less and capacitor-less ignition system for spark-ignition internal combustion engine comprising a cup-like housing having an end wall and an open end, a removable dielectric cap closing said open end, a plurality of peripheral output terminals disposed on said cap with a portion of said terminals projecting through said cap and each of said terminals being connected to a spark plug, an input terminal centrally disposed on said cap with a portion of said terminal projecting through said cap, a high voltage high frequency generator constantly electrically connected to said input terminal, a rotatable shaft projecting through the end wall of said housing, a rotor member mounted on the end of said shaft for rotation thereby, an electrical contact carried by said rotor member, said electrical contact having an end constantly engaged with said input terminal and another end disposed on said rotor member for circular displacement thereby in close gap proximity to each one of said output terminals successively in the course of a revolution of said shaft and rotor member, a dielectric timing ring disposed between said rotor member and said output terminals, electrically conductive segments disposed through the wall of said timing ring, each of said segments corresponding to one of said output terminals and forming a spark gap therewith and with said rotor member contact end, timing means for angularly displacing said timing ring relative to said output terminals for varying the timing of occurrence of start of sparking across said spark gap relative to degree of angular rotation of said shaft, the duration of said sparking being a function of the arc length of each of said segments, and electrical conductor means connecting said output terminals to the spark plugs of said internal combustion engine.

4. The system of claim 3 wherein said timing means comprises a plate disposed in said housing for supporting said timing ring and means controlled by conventional distributor timing means for angularly positioning said plate relative to said output terminals.

* * * * *